United States Patent [19]

Nara et al.

[11] 4,279,864

[45] Jul. 21, 1981

[54] MONOLITHIC CATALYST CONVERTER

[75] Inventors: Akio Nara, Nishio; Shigeru Takagi, Okazaki; Kazuma Matsui, Toyohashi, all of Japan

[73] Assignee: Nippon Soken, Inc., Nishio, Japan

[21] Appl. No.: 99,753

[22] Filed: Dec. 3, 1979

[30] Foreign Application Priority Data

| | | | |
|---|---|---|---|
| Dec. 4, 1978 | [JP] | Japan | 53/150336 |
| Dec. 27, 1978 | [JP] | Japan | 53/180300[U] |
| Mar. 15, 1979 | [JP] | Japan | 54/30420 |

[51] Int. Cl.[3] ..... F01N 3/28; F01N 7/14; F01N 7/16

[52] U.S. Cl. ..... 422/179; 422/180

[58] Field of Search ..... 422/179, 180

[56] References Cited

U.S. PATENT DOCUMENTS

| | | | |
|---|---|---|---|
| 3,963,445 | 6/1976 | Koyama et al. | 422/179 |
| 4,043,761 | 8/1977 | Gaysert et al. | 422/179 |
| 4,142,864 | 3/1979 | Rosynsky et al. | 422/179 |

FOREIGN PATENT DOCUMENTS

| | | | |
|---|---|---|---|
| 2233886 | 1/1974 | Fed. Rep. of Germany . | |
| 49-44111 | 4/1974 | Japan . | |
| 562396 | 5/1975 | Switzerland | 422/179 |
| 1410134 | 10/1975 | United Kingdom | 422/179 |

*Primary Examiner*—Bradley Garris

*Attorney, Agent, or Firm*—Cushman, Darby & Cushman

[57] ABSTRACT

A monolithic catalyst converter comprises a monolithic catalyst retaining catalyst metal, a cylindrical metallic container receiving the catalyst therein, a radial shock absorbing member disposed in a space between the catalyst and the container, an annular metallic plate disposed in each of axially end surfaces of the catalyst, a retaining member fixed to an inner wall of the container so as to be opposed to the annular metallic plate, an axial shock absorbing member disposed between the annular metallic plate and the retaining member and at least one annular sealing member composed of a compact body obtained by compressing metallic fine wire fabric or ceramic fibers, which is disposed in the space under pressure. By disposing the annular sealing member, unpurified exhaust gas is prevented from flowing out of the space.

4 Claims, 13 Drawing Figures

MONOLITHIC CATALYST CONVERTER

SUMMARY OF THE INVENTION

The present invention relates to a monolithic catalyst converter to be disposed within an exhaust gas passage of a motor car and the like in order to decrease harmful components of the exhaust gas discharged from an internal combustion engine thereof.

The monolithic catalyst converter comprises a monolithic catalyst 1 and a metallic cylindrical container 2 receiving the monolithic catalyst 1 therein as shown in FIG. 1. The monolithic catalyst 1 is formed by retaining catalyst metal on inner wall surfaces of a plurality of axially extending passages of a ceramic carrier 10 having a honeycomb structure.

Both ends of the container 2 are connected with diverged ends 31*a* and 31*b* of a conical exhaust gas inlet pipe 3*a* and a conical exhaust gas outlet pipe 3*b*, respectively. Converged ends 32*a* and 32*b* of the exhaust gas inlet pipe 3*a* and the exhaust gas outlet pipe 3*b* are connected with exhaust pipes, respectively.

In order to prevent the monolithic catalyst 1 from being broken by shocks and vibrations of the radial directions thereof, a radial shock absorbing member 40 which is produced by weaving wave-shaped metallic wires is inserted in a space 4 between the catalyst 1 and the container 2. The radial shock absorbing member 40 resiliently supports the monolithic catalyst 1.

Retaining members 5*a* and 5*b* are fixed to the inner wall of both ends of the container 2, respectively. Projecting portions 51*a* and 51*b* of the retaining members 5*a* and 5*b* are bent so as to be opposed to end surfaces of the monolithic catalyst 1 at a predetermined distance.

Annular metallic sealing plates 6*a* and 6*b* are disposed so as to abut on the end surfaces of the monolithic catalyst 1. And axial shock absorbing members 7*a* and 7*b* which are produced by weaving metallic fine wires and compressing the obtained metallic fine wire fabric into an annular compact body, respectively are inserted under pressure between the projecting portion 51*a* and the metallic sealing plate 6*a* and between the projecting portion 51*b* and the metallic sealing plate 6*b* to absorb vibrations and shocks in the axial direction of the monolithic catalyst 1. The sealing plates 6*a* and 6*b* are made shorter than the inner diameter of the container 2 in order to prevent them from being broken due to a high temperature of the exhaust gas. If the sealing plates 6*a* and 6*b* are contacted with the inner surface of the container 2, they are broken due to the difference of the thermal expansion between the container 2 and the sealing plates 6*a* and 6*b*.

In the conventional monolithic catalyst converter having the above described structure, a part of the exhaust gas flows into the space 4 through pores of the axial shock absorbing member 7*a* as shown by arrows C-1 and C-2 of FIG. 2. And the corner portion of the catalyst 1 is likely to be broken due to shocks or vibrations since the corner portion is contacted with the sealing plate 6*a* and then a part of the exhaust gas flows into the space 4 between the sealing plate 6*a* and the broken corner portion of the catalyst 1 as shown by arrows D-1 and D-2 of FIG. 2. As a result, a part of the exhaust gas which flows through the space 4 is not purified by the monolithic catalyst 1.

Thus, the conventional monolithic catalyst converter has a drawback that the amount of harmful components of the exhaust gas is not decreased.

Accordingly, an object of the present invention is to provide an improved monolithic catalyst converter which decreases harmful components of the exhaust gas discharged from an internal combustion engine of a motor car and the like.

Another object of the present invention is to provide an improved monolithic catalyst converter which prevents the unpurified exhaust gas from being discharged from a space between a monolithic catalyst and a container thereof over a long period of time.

DESCRIPTION OF THE DRAWINGS

Other objects and advantages of the invention will become apparent from the following description of embodiments with reference to the accompanying drawings wherein:

FIG. 1 is a vertical sectional view of the conventional monolithic catalyst converter;

FIG. 2 is an enlarged view of the portion A of FIG. 1;

FIG. 3 is a front view of the annular sealing member of the first embodiment;

FIGS. 4(*a*) and 4(*b*) are enlarged sectional views taken along the line IV—IV of FIG. 3 when the sealing member has a V or U-shaped cross section, respectively;

DETAILED DESCRIPTION

According to the present invention, an annular sealing member is disposed in a space between a monolithic catalyst and a container so as to radially support the monolithic catalyst. A compact body obtained by compressing heat-resistant metallic fine wire fabric or ceramic fibers is used as the material of the sealing member. Such a compact body as described above has high density. And it has excellent heat-resistance and resiliency. Therefore, by inserting the compact body having the above described characteristics under pressure in the above described space as a sealing member, the exhaust gas is prevented from flowing out of the space. And it can be used for a long period of time without breaking the monolithic catalyst.

When the compact body composed of metallic fine wire fabric is used as a sealing member, it is preferable to form it into a saddle shape of which the cross sectional shape is a letter V shape or a letter U shape, and to dispose it so that the bottom portion thereof is contacted under pressure with an inner wall of the metallic container and so that the end portions thereof are contacted under pressure with an outer wall of the monolithic catalyst. The sealing member having a V-shaped or U-shaped cross section exhibits high resiliency so that it closely contacts with the monolithic catalyst and the metallic container compared with other sealing members.

Hereinafter, the present invention will be explained in detail in accordance with various embodiments.

Figure 3:
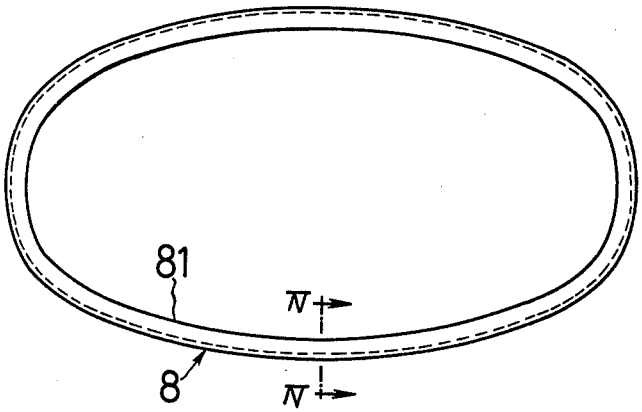
FIG. 3 and FIGS. 4(*a*) and 4(*b*) show an annular sealing member used in the monolithic catalyst converter of a first embodiment of the present invention.
Figure 4A:
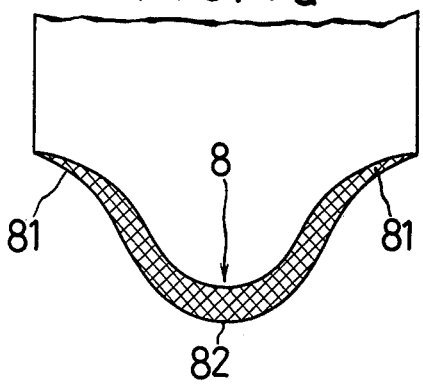
Figure 4B:
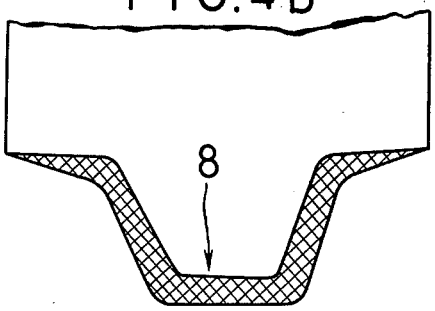
Figure 5:
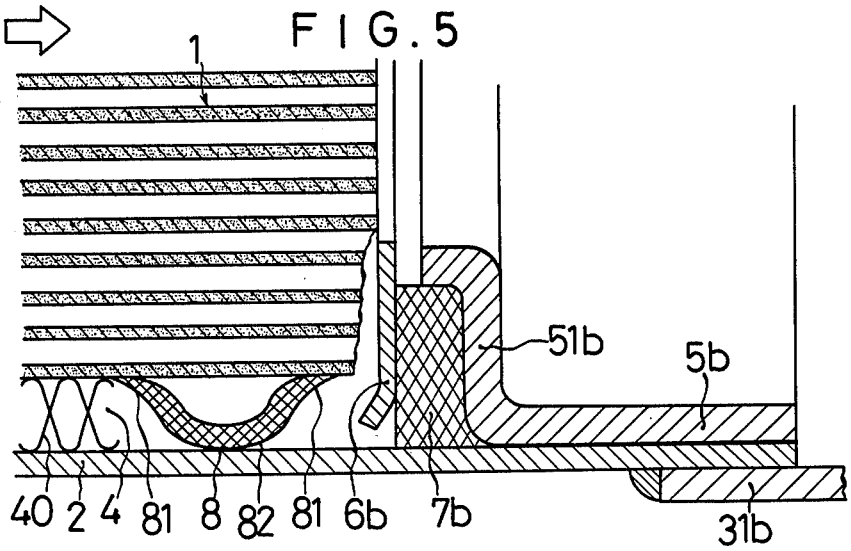
FIG. 5 is a partially cut away vertical sectional view of the monolithic catalyst converter of the first embodiment of the present invention.

According to a first embodiment, an annular sealing member 8 made of metallic fine wire fabric formed into a V-shaped or U-shaped cross section as shown in FIGS. 3,4(*a*) and 4(*b*), is inserted in a space 4 formed between a container 2 and a monolithic catalyst 1 as shown in FIG. 5. The sealing member 8 of the first embodiment is formed by compressing metallic fabric made of heat-resistant metallic fine wires to the density of 3 to 5.5 g/cm$^3$ so as to fit the contour of the outer wall of the monolithic catalyst 1 as shown in FIG. 3. The heat-resistant metallic fine wires are, for example, stainless steel fine wires having a diameter of 0.1 mm to 0.15 mm is used. When the density of the obtained annular compact body is under 3 g/cm$^3$, the exhaust gas cannot be prevented from flowing therethrough, and it is difficult to form the compact body having the density over 5.5 g/cm$^3$ by the usual compressing technique. Therefore, the practical range of the density of the obtained annular compact body is 3 to 5.5 g/cm$^3$.

As shown in FIG. 5, the sealing member 8 having a V-shaped cross section is inserted in the space 4 under pressure so that the bottom portion 82 thereof is contacted with the inner wall of the metallic container 2 and the both ends 81 thereof are contacted with the outer wall of the monolithic catalyst. Since the sealing member 8 is resiliently disposed in contact with the monolithic catalyst 1 and the container 2, the exhaust gas is prevented from flowing into the space 4.

In FIG. 5, the sealing member 8 having a V-shaped cross section is used. In addition, the sealing member having a U-shaped cross section as shown in FIG. 4(*b*) can be used. And a sealing member having a wave-shaped cross section, which is a series of two or three sealing members having a U or V-shaped cross section, can be also used. By forming the sealing member into the above described cross section, the excellent resiliency of the sealing member is obtained so that the sealing member closely contacts with the container 2 and the monolithic catalyst 1 to exhibit an excellent sealing effect.

Since the sealing member 8 is made of a compressed metallic fine wire fabric, the components of the sealing member 8 do not disperse due to the exhaust gas flow. Therefore, it can be used over a long period of time. And by forming both ends 81 of the sealing member 8 thinner than the other portions as shown in FIG. 5, the sealing member 8 closely contacts with the outer surface of the monolithic catalyst 1 to effectively prevent the exhaust gas from leaking from the contact surface between the catalyst 1 and the sealing member 8.

Figure 6:
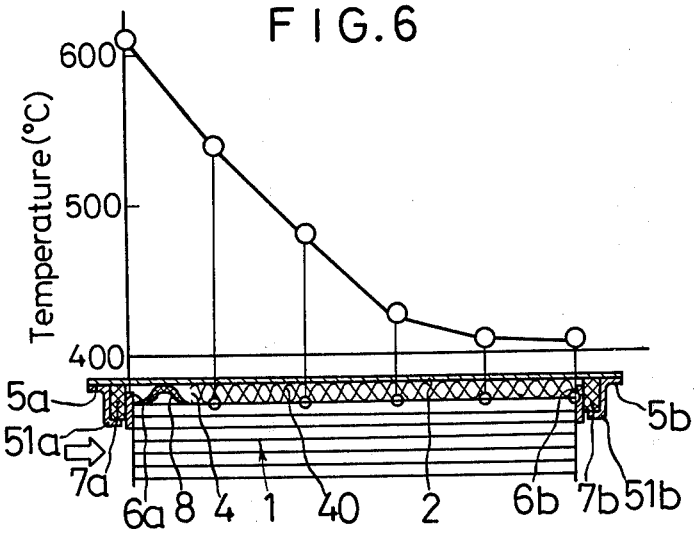
FIG. 6 is a graph showing an experimental result of the temperature distribution in the surface of the monolithic catalyst of the present invention.

FIG. 6 shows the temperature distribution in the surface of the monolithic catalyst 1 when the internal combustion engine is operated. The temperature becomes lower gradually from the exhaust gas inlet side to the exhaust gas outlet side of the monolithic catalyst 1. Especially, near the exhaust gas outlet port of the catalyst 1, the temperature is very low. Though the temperature of the catalyst 1 is increased to about 600° C. near the exhaust gas inlet port, the temperature is only about 400° C. near the exhaust gas outlet port. Therefore, when the sealing member 8 is disposed near the exhaust gas inlet port, the resiliency of the sealing member 8 is gradually decreased so that the sealing effect of the sealing member 8 is gradually lowered. From the above reason, in order to maintain the excellent sealing effect for a long period of time, the sealing member 8 should be disposed near the exhaust gas outlet port of the monolithic catalyst 1, of which temperature is maintained relatively low.

Figure 7:
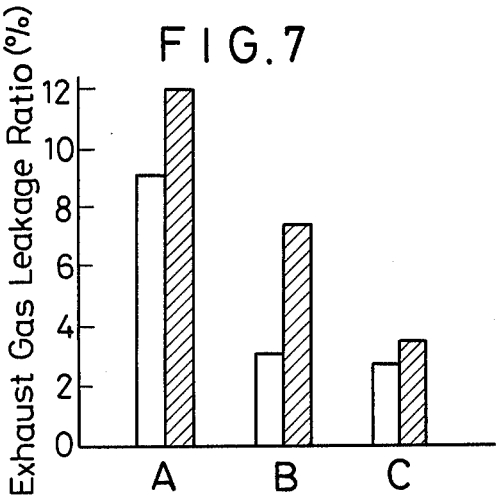
FIG. 7 is a graph showing an experimental result of the exhaust gas leakage ratio of the conventional monolithic catalyst converter (A) and the monolithic catalyst converters (B) and (C) of the present invention at a starting time and after used for a longer period of time.

FIG. 7 shows the exhaust gas leakage ratio of the monolithic catalyst converter of the present invention and the conventional monolithic catalyst converter. A is an experimental result of the conventional converter, B is that of the monolithic converter of the present invention which comprises a sealing member 8 positioned near the exhaust gas inlet port of the catalyst 1, and C is that of the monolithic converter of the present invention which comprises a sealing member 8 positioned near the exhaust gas outlet port of the catalyst 1. In FIG. 7, white bars show exhaust gas leakage ratios measured directly after each of the monolithic catalysts was started to be used and shaded bars show exhaust gas leakage ratios measured after each of the monolithic catalysts was used for a long period of time.

The experiment was carried out under the following conditions.

| | |
|---|---|
| engine displacement: | 2600cc |
| number of engine cylinders: | 6 |
| number of revolutions: | 1500rpm |
| intake manifold negative pressure: | −200mmHg |
| air-fuel ratio: | 16 |

The experimental result shown by shaded bars was obtained by repeating the cycle of alternately flowing a gas of which temperature is 800° C. in the inlet port of the catalyst converter for ten minutes and a gas of which temperature is 120° C. for five minutes, for 100 hours.

As is apparent from the experimental result, the exhaust gas leakage ratios measured directly after the starting time of the monolythic catalyst converters B and C of the present invention are one third or less of that of the conventional converter, respectively. And the exhaust gas leakage ratio measured after the monolithic catalyst converter B is used for a long period of time is remarkably decreased compared with the conventional converter A and becomes lower than the exhaust gas leakage ratio measured directly after the starting time of the conventional converter A. The monolithic catalyst converter C of the present invention exhibits especially excellent performance. Namely, even after a long period of time, the exhaust gas leakage ratio thereof is maintained very low and is almost the same as the exhaust gas leakage ratio measured directly after the starting time.

The hydrocarbon emission volume of the monolithic catalyst converter of the present invention is also decreased in proportion to the decrement of the exhaust gas leakage ratio thereof.

As described above, the monolithic catalyst converter of the first embodiment comprising a sealing member 8 is superior to the conventional converter in the preventing effect of the exhaust gas leakage and the hydrocarbon emission.

Especially, the monolithic catalyst converter C comprising a sealing member 8 positioned in the outlet side of the catalyst 1 has an excellent effect of preventing the exhaust gas leakage and the hydrocarbon emission.

Figure 8:
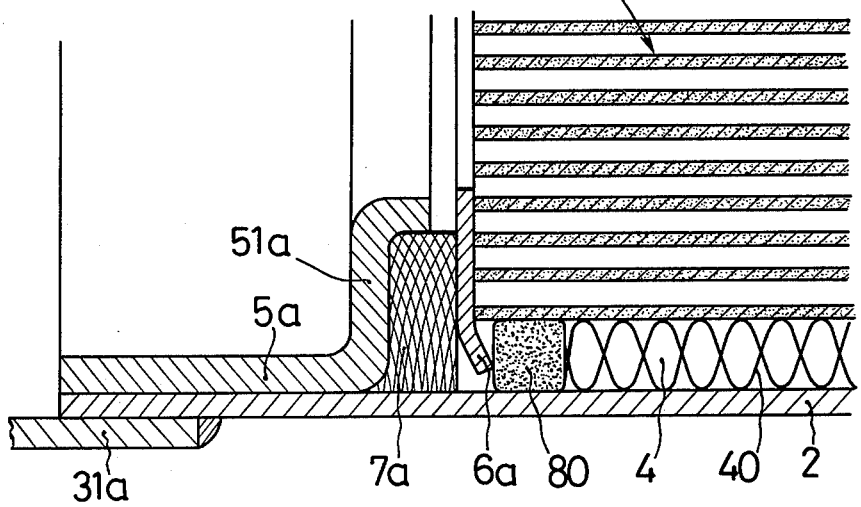
FIG. 8 is a partially cut away vertical sectional view of the monolithic catalyst converter of a second embodiment.

According to a second embodiment as shown in FIG. 8, an annular compact body 80 composed of ceramic fibers such as alumina and silica is disposed between the sealing plate 6*a* and the shock absorbing member 40 in the space 4 near the exhaust gas inlet port of the monolithic catalyst 1. The compact body 80 is contacted with the outer wall of the monolithic catalyst 1 and the inner wall of the container 2. And also, in the exhaust gas outlet side of the space 4, the same compact body as the compact body 80 is disposed.

In the monolithic catalyst converter having the above described structure, a part of the exhaust gas flowing from the exhaust gas inlet pipe 3*a* passes the gap between the sealing plate 6*a* and the inner wall of the container 2 through pores of the metallic fine wire fabric 7*a*. But the exhaust gas is prevented from flowing into the space 4 by the compact body 80 made of ceramic fibers. And even if the exhaust gas leakes out of the compact body 80, the volume thereof is very small. Furthermore, the leaking exhaust gas is prevented from flowing out of the space 4 by the ceramic fiber compact body disposed in the outlet side of the space 4.

It is preferable that the density of the ceramic fiber compact body is 0.1 to 0.5 g/cm$^3$. Under 0.1 g/cm$^3$, the exhaust gas cannot be effectively prevented from leaking therethrough. Over 0.5 g/cm$^3$, the compact body does not closely contact with the outer wall of the monolithic catalyst 1 and the inner wall of the container 2. Furthermore, in this case gaps are likely to occur in the contact portions thereof.

Since the remarkable pressure variation of the exhaust gas is decreased by the axial shock absorbing member 7*a* and the sealing plate 6*a*, the ceramic fibers scarcely peel off from the outer peripheral portion of the compact body 80. Thus, the ceramic fiber compact body 80 can be used for a long period of time.

Figure 9:
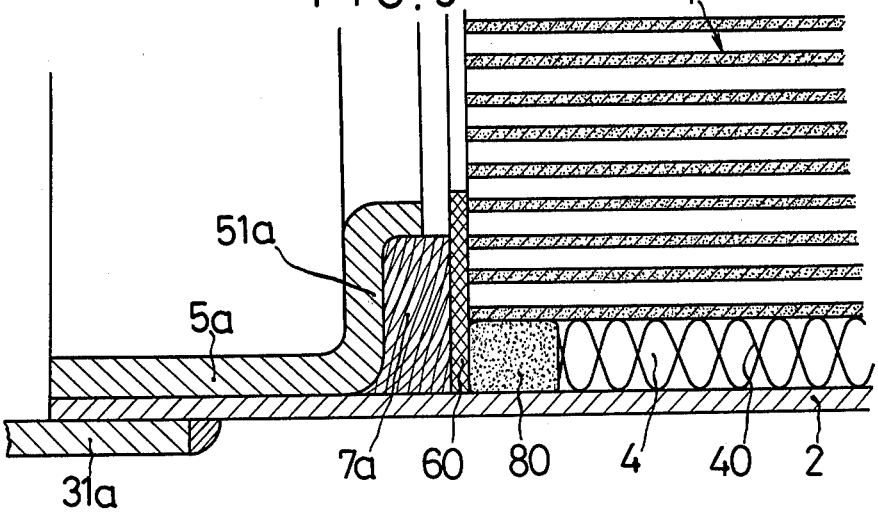
FIG. 9 is a partially cut away vertical sectional view of the monolithic catalyst converter of a third embodiment.

According to a third embodiment of the present invention, an annular sealing member 60 (FIG. 9) made of metallic fine wire fabric is inserted so as to be closely contacted with the inner wall of the container 2. The metallic fine wire fabric used as the sealing member 60 has larger density and higher hardness than those of the axial shock absorbing member. And the same compact body 80 as that of the second embodiment is inserted in the space 4 between the catalyst 1 and the container 2 in contact with the annular sealing member 60.

In the monolithic catalyst converter of the third embodiment having the above described structure, the shock or the pressing force occurring between the container 2 and the sealing member 60 due to the vibrations and the difference of thermal expansion is absorbed by the resilient sealing member 60. Therefore, the corner portion of the monolithic catalyst 1 which is contacted with the sealing member 60 is prevented from being broken due to the resiliency of the sealing member 60.

And the volume of the exhaust gas flowing into the space 4 becomes very small since the inlet port of the space 4 is sealed by the sealing member 60.

Furthermore, the pressure variation of the exhaust gas operating upon the ceramic fiber compact body 80 is decreased still more by the sealing member 60 so that the ceramic fibers scarcely peel off from the compact body 80.

Figure 10:
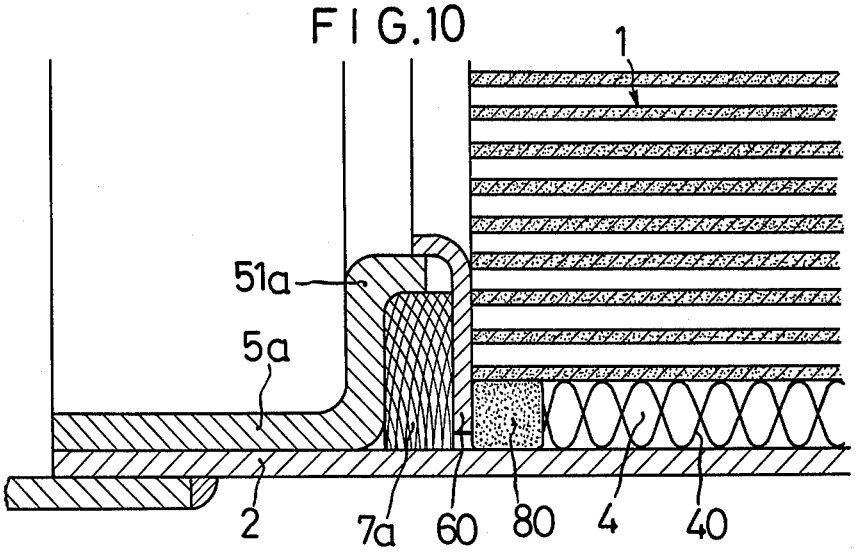
FIG. 10 is a partially cut away vertical sectional view of the monolithic catalyst converter of a fourth embodiment.

According to a fourth embodiment shown in FIG. 10, the inner peripheral portion of the annular sealing plate 60 is bent to the direction of the retaining member 5*a* so as to be slidably contacted with the projecting portion 51*a* of the retaining member 5*a* and a sealing member 80 which is the same as the sealing member 80 of the second embodiment is disposed in the space 4 between the catalyst 1 and the container 2 as shown in FIG. 10. By slidably contacting the sealing plate 60 with the retaining member 5*a*, the exhaust gas is almost completely prevented from flowing into the space 4 through the axial shock absorbing member 7*a*. And if a part of the exhaust gas flows into the space 4, it is prevented from flowing farther by the sealing member 80.

Since the gas pressure acting upon the sealing member 80 is very small, the ceramic fibers of the sealing member 80 scarcely peel off therefrom.

Furthermore, since the sealing plate 60 and the projecting portion 51*a* of the retaining member 5*a* are slidably contacted with each other, the shock absorbing effect of the axial shock absorbing member 7*a* cannot be lowered thereby.

Figure 11:
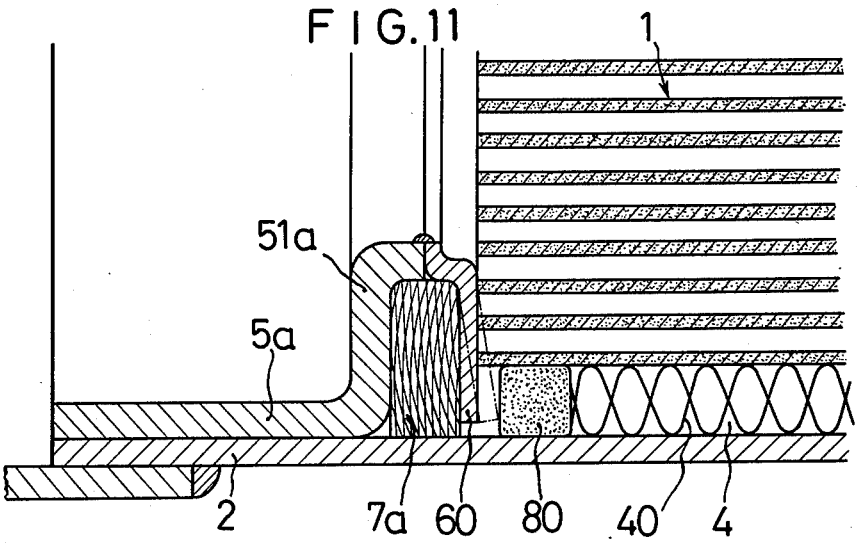
FIG. 11 is a partially cut away vertical sectional view of the monolithic catalyst converter of a fifth embodiment.

FIG. 11 shows a fifth embodiment of the present invention.

According to the fifth embodiment, the projecting portion 51*a* of the retaining member 5*a* and the inner peripheral portion of the sealing plate 60 are pivotally welded in their inner peripheral surfaces so that the sealing plate 6 is positioned as shown by an alternate long and two short dashes line under a free condition. Therefore, the sealing plate 60 is positively pressed by the end portion of the monolithic catalyst 1 when it is installed in the monolithic catalyst converter.

And a sealing member 80 which is the same as the sealing member of the second embodiment is disposed in the space 4 between the catalyst 1 and the container 2.

Figure 1:
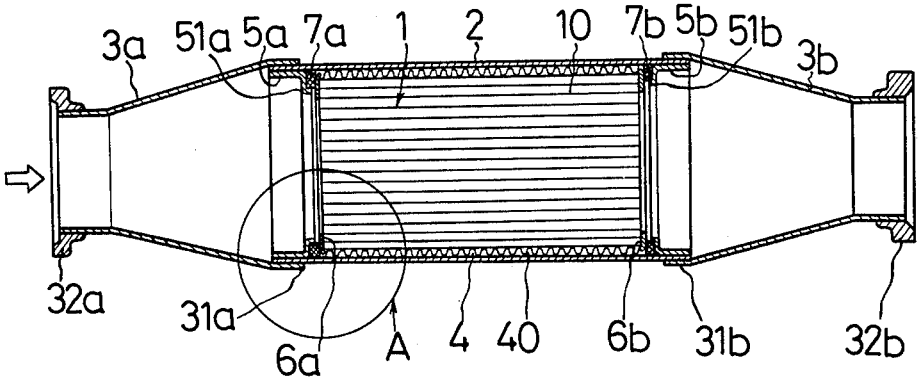
FIG.1 PRIOR ART
FIG. 1 and FIG. 2 show a conventional monolithic catalyst converter.
Figure 2:
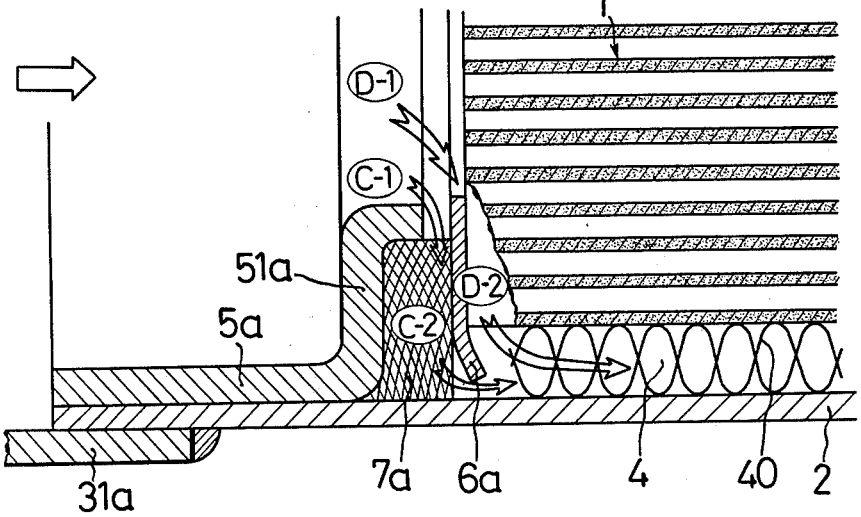
FIG.2 PRIOR ART

In the monolithic catalyst converter of the fifth embodiment, when the corner portions of the catalyst 1 are broken as shown in FIG. 2, the sealing plate 60 is maintained contacted with the catalyst 1. Therefore, the exhaust gas can be almost prevented from flowing through the gap between the sealing plate 6 and the corner portions of the catalyst 1.

And if a small amount of the exhaust gas flows through the gap between the monolithic catalyst 1 and the sealing plate 60, it is prevented from flowing into the space 4 by the sealing member 80. As a result, the exhaust gas pressure acting upon the sealing member 80 can be made low so that the ceramic fibers of the sealing member 80 scarcely peel off therefrom.

The ceramic fibers can be also prevented from peeling off from the outer peripheral portion of the sealing member 80 by covering it with a heat-resistant metallic net.

Figure 12:
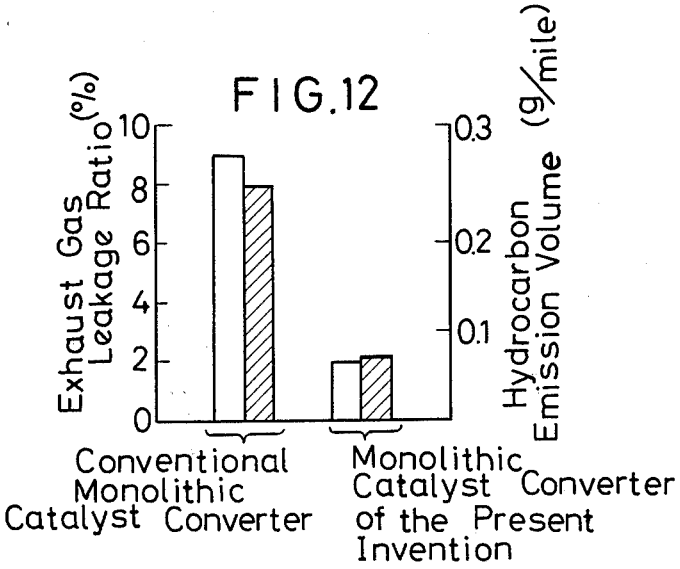
FIG. 12 is a graph showing an experimental result of the exhaust gas leakage ratio and the hydrocarbon emission volume of the conventional monolithic catalyst converter and the monolithic catalyst converter of the present invention.

FIG. 12 shows an experimental result of the exhaust gas leakage ratio and the hydrocarbon emission volume of the conventional monolithic catalyst converter without comprising the sealing member 80 and those of the monolithic catalyst converter of the second embodiment of the present invention as shown in FIG. 8.

The monolithic catalyst converter of the second embodiment used in the above experiment comprises two sealing members 80 which are disposed in both ends of the space 4. The density of each of the sealing members 80 is 0.4 g/cm$^3$, the thickness thereof is 4 mm and the width thereof is 15 mm.

The experiment was carried out under the following conditions.

| | |
|---|---|
| engine displacement: | 2600cc |
| number of engine cylinders: | 6 (disposed in series) |
| number of revolutions: | 1500rpm |
| intake manifold negative pressure: | −200mmHg |
| air-fuel ratio: | 16 |

In FIG. 12, bar graphs A show the experimental result of the conventional monolithic catalyst converter and bar graphs B show the experimental result of the monolithic catalyst converter of the present invention. White bars show the exhaust gas leakage ratio (%) and shaded bars show the hydrocarbon emission volume(g-/mile).

As is apparent from FIG. 12, each of the exhaust gas leakage ratio and the hydrocarbon emission volume of the monolithic catalyst converter of the present invention is decreased to one fourth of each of those of the conventional monolithic catalyst converter.

As described above, according to the present invention, the monolithic catalyst is positively supported in the radial and axial direction thereof so that the damage of the monolithic catalyst due to the vibrations and the shock of the internal combustion engine can be remarkably decreased.

Furthermore, according to the present invention, the unpurified exhaust gas can be effectively prevented from leaking out of the space formed between the inner wall of the metallic container and the outer wall of the monolithic catalyst by disposing sealing members having high density in the space.

And in the monolithic catalyst converter of the present invention, heat-resistant compact bodies made of ceramic fibers or metallic fine wire fabric are used as the sealing members, so that they continue to exhibit the excellent sealing effect over a long period of time.

Having now fully described the invention, it will be apparent to one of ordinary skill in the art that many changes and modifications can be made thereto without departing from the spirit or scope of the invention as set forth herein.

What is claimed is:

1. A monolithic catalyst converter to be disposed in an exhaust gas passage of an internal combustion engine comprising:

a monolithic catalyst composed of a honeycomb structure having a plurality of axially extending open passages and retaining catalyst metal in the walls defining said passages;

a cylindrical metallic container for receiving said catalyst therein;

a radial shock absorbing member composed of metallic fine wires, which is disposed in a space between said monolithic catalyst and said container;

the annular metallic plate disposed in the periphery of each of the axial end surfaces of said monolithic catalyst, a retaining member fixed to an inner wall of said container in each of the ends thereof so as to be opposed to said plate at a predetermined distance;

an axial shock absorbing member composed of metallic fine wire fabric, which is disposed between said plate and said retaining member; and at least one heat-resistance and resilient annular sealing member having high density which is disposed in said space between said monolithic catalyst and said container under pressure for preventing passage of exhaust gas through that space, said annular sealing member being a compact body of compressed metallic fine wire fabric and having a saddle shape in radial cross section for continuously causing an effective exhaust gas seal of said space even though said sealing member has said high density and even when the container is subjected to temperature changes during operation of said converter, wherein said annular sealing member has a radial cross section of a letter V or a letter U shape and a bottom portion of said sealing member is contacted with the inner wall of said container and edge portions of said sealing ember are contacted with the outer wall of said catalyst.

2. A monolithic catalyst converter according to claim 1, wherein:

said edge portions of said sealing member are thinner than the other portions thereof.

3. A monolithic catalyst converter according to claim 1, wherein:

said annular sealing member is disposed under pressure near an exhaust gas outlet port of said monolithic catalyst.

4. A monolithic catalyst converter according to claim 1, wherein:

said compact body made of metallic fine wire fabric has density of 3 to 5.5 g/cm$^3$.

* * * * *